US006869297B2

(12) United States Patent
Caveney

(10) Patent No.: US 6,869,297 B2
(45) Date of Patent: Mar. 22, 2005

(54) CONNECTOR DOOR HAVING OVERTRAVEL STOPS

(75) Inventor: Jack E. Caveney, Hinsdale, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 10/347,214

(22) Filed: Jan. 17, 2003

(65) Prior Publication Data

US 2004/0142589 A1 Jul. 22, 2004

(51) Int. Cl.[7] ..... H01R 13/44
(52) U.S. Cl. ..... 439/138; 439/248; 439/676
(58) Field of Search ..... 439/135–138, 439/140–144, 372, 676, 948, 672

(56) References Cited

U.S. PATENT DOCUMENTS

| | | | | |
|---|---|---|---|---|
| 4,666,225 A | | 5/1987 | Hampton et al. | |
| 4,712,861 A | | 12/1987 | Lukas et al. | |
| 4,713,016 A | * | 12/1987 | Kato | 439/137 |
| 4,779,950 A | | 10/1988 | Williams | |
| 4,847,711 A | | 7/1989 | Inoue | |
| 4,960,317 A | | 10/1990 | Briggs et al. | |
| 5,302,141 A | * | 4/1994 | O'Reilly et al. | 439/680 |
| 5,506,922 A | | 4/1996 | Grois et al. | |
| 5,603,623 A | * | 2/1997 | Nishikawa et al. | 439/144 |
| 5,634,802 A | | 6/1997 | Kerklaan | |
| 5,716,224 A | | 2/1998 | Masuda et al. | |
| 5,769,647 A | | 6/1998 | Tulley et al. | |
| 5,800,188 A | * | 9/1998 | Barber et al. | 439/142 |
| 5,871,364 A | * | 2/1999 | Shinchi et al. | 439/144 |
| 5,873,744 A | * | 2/1999 | Ramos, Jr. | 439/144 |
| 5,938,480 A | | 8/1999 | Aldous et al. | |
| 5,956,444 A | | 9/1999 | Duda et al. | |
| 5,964,600 A | | 10/1999 | Miles et al. | |
| 6,004,043 A | | 12/1999 | Abendschein et al. | |
| 6,010,343 A | * | 1/2000 | Konoya et al. | 439/144 |
| 6,106,335 A | | 8/2000 | Merchant et al. | |
| 6,108,482 A | | 8/2000 | Roth | |
| 6,130,977 A | * | 10/2000 | Rosson | 385/76 |
| 6,154,597 A | | 11/2000 | Roth | |
| 6,196,854 B1 | | 3/2001 | Hand | |
| 6,247,849 B1 | * | 6/2001 | Liu | 385/55 |
| 6,292,564 B1 | | 9/2001 | Cowan et al. | |
| 6,354,746 B1 | * | 3/2002 | Lee | 385/77 |
| 6,375,480 B1 | * | 4/2002 | Chen et al. | 439/142 |
| 6,558,175 B1 | * | 5/2003 | Yu | 439/138 |
| 6,595,696 B1 | * | 7/2003 | Zellak | 385/72 |

OTHER PUBLICATIONS

Figure 1: A front photograph of a 3M Volition RJ45 K5e Jack–Model No. VOL–OCK5E–U.

Figure 2: A bottom–left photograph of the front of a 3M Volition RJ45 Ke Jack –Model No. VOL–OCK5E–U.

3M News Bulletin: New 3M Volition Category 5e Cabling System Targets Distributed Networks, etc.

3M Volition Network Solutions Product Bulletin: Leading the Way in Network Migration, etc.

3M Volition Copper Cabling System Product Bulletin: Category 5e Structured Cabling System.

3M Volition Copper Cabling System Product Bulletin: Category 6 Structured Cabling System.

* cited by examiner

*Primary Examiner*—P. Austin Bradley
*Assistant Examiner*—X. Chung-Trans
(74) *Attorney, Agent, or Firm*—Robert A. McCann; Zachary J. Smolinski

(57) ABSTRACT

A jack for receiving and connecting with a compatible plug, the jack including a housing having a plug-receiving chamber therein, the housing having an orifice through which the plug is insertable into and removable from the chamber, and a pivotable prebiased door having a closed position generally disposed over the orifice when the plug is not disposed within the chamber and an open position not generally disposed over the orifice when the plug is disposed within the chamber, the door including a projecting portion for limiting the extent of insertion of the plug into the chamber.

3 Claims, 8 Drawing Sheets

10
14
30
18

14
32
24
18
12
16
24

52
50

CONNECTOR DOOR HAVING OVERTRAVEL STOPS

BACKGROUND OF THE INVENTION

The continuous demand for faster and higher quality signal transmission has led to connectors, such as those meeting Category 6 specifications, providing low crosstalk and high performance connectivity for electrical cabling. Such high performance demands augment the need to maintain a connection environment devoid of foreign debris that may directly interfere with electrical connections, or may indirectly diminish performance by eroding and degrading connective hardware over time.

To inhibit the passage of foreign matter into or through a connector, some have tried using one or more protective shields disposed variously on or within the connector, particularly in fiber optic applications. Just as damage to an electrical contact or terminal may deteriorate the performance of an electrical connector, concern for the prospect of damage to a fiber end is justified because such damage can degrade the quality of the signal transmitted over the fiber optic connector. U.S. Pat. No. 6,004,043 discloses, for example, a shuttered fiber optic receptacle wherein an inclined planar shutter near the mouth of the receptacle helps protect against contamination while, due to its inclined state, avoiding the reflection of light back into the fiber optic core during mating. U.S. Pat. No. 6,154,597 discloses a fiber optic connector having a pair of doors cooperating to open and close a first receptacle end and a separate door to open and close a second receptacle end. U.S. Pat. No. 6,108,482 discloses a fiber optic connector receptacle having a one-piece shutter with a recessed area for protecting the end of fiber being inserted therein. As fiber ends are commonly pre-polished, such damage may particularly thwart an expensive effort to provide hardware capable of reliable, high-performance communication. Likewise with electrical contacts, especially in high-performance environments, contact with a door or bulkhead has the potential to bend or otherwise deform particular contacts, potentially threatening the ability of the contact to connect properly with a mating piece or potentially diminishing the performance characteristics of the terminal or others around it.

In some prior connectors, the point of full insertion of the plug may be marked by the electrical contacts (or a fiber end) abruptly contacting a bulkhead, stop, or housing back wall that may damage the contact (or fiber end) and thereby degrade performance of the connector. Even an abrupt mating with other electrical contacts may cause undesirable effects. Thus, there is a need for a connector able to deter the passage of foreign debris into the connective environment while simultaneously preventing damage to the connective apparatus, such as extending terminals, throughout the insertion path of the inserted plug.

SUMMARY OF THE INVENTION

The jack includes a pivotable prebiased door that includes a projecting portion for limiting the extent of insertion of the plug into the chamber of the jack. In this manner, the welfare of the plug contacts is preserved, even at the point of full insertion, because the projections protect against the contacts impacting a bulkhead, stop, or housing back wall. In this manner, degraded performance of the connector is avoided. In addition to its regular application, such an advantage may be useful in a test jack, wherein many plugs (or fiber ends) would be inserted for testing and subsequently removed from the jack over a period of time, and these many plugs would thereby avoid potential damage to the contacts (or fiber ends) thanks to the overtravel-protecting projecting portion of the door.

In one embodiment of the invention, there is provided a jack for receiving and connecting with a compatible plug, the jack including a housing having a plug-receiving chamber therein, the housing having an orifice through which the plug is insertable into and removable from the chamber, and a pivotable prebiased door having a closed position generally disposed over the orifice when the plug is not disposed within the chamber and an open position not generally disposed over the orifice when the plug is disposed within the chamber, the door including a projecting portion for limiting the extent of insertion of the plug into the chamber.

In another embodiment of the invention, there is provided a method of assembling a jack for receiving and electrically connecting with a compatible plug, the method including the steps of providing an integrally formed housing having a pair of opposed top and bottom walls and a pair of opposed side walls extending between the top and bottom walls and having a forwardly facing orifice and rearwardly facing opening defined by the top, bottom, and side walls, providing a sled member having accessible electrical conductors proximate a forward end thereof for cooperatively engaging electrical conductors on the compatible plug when the plug is received in the jack, inserting at least the forward end of the sled member into the rearwardly facing opening proximate the bottom wall, providing a door having a pivot bar and a torsional spring mounted thereto, inserting the door into the housing through the rearwardly facing opening between the sled member and the top wall and into a position wherein the door may be biased by the spring to substantially cover the forwardly facing orifice, providing a rear bulkhead member, and inserting the rear bulkhead member into the rearwardly facing opening between the sled member and the top wall of the housing to, in conjunction with the sled member, substantially close the rearwardly facing opening of the housing.

In yet another embodiment of the invention, there is provided a jack for receiving and connecting with a compatible plug, the plug including a depressible latch, the jack including a housing including a pair of opposed top and bottom walls, a pair of opposed side walls extending between the top and bottom walls, and a rear bulkhead, the top, bottom, side walls and the rear bulkhead substantially defining a chamber having a forwardly facing orifice through which the plug is insertable into and removable from the chamber, the rear bulkhead not being integrally formed with any of the top, bottom, and side walls, and a pivotable prebiased door having a torsional spring mounted thereto and having a closed position generally disposed over and flush with the orifice when the plug is not disposed within the chamber to substantially prevent foreign matter from entering the chamber and an open position not generally disposed over the orifice when the plug is disposed within the chamber, the door including a projecting portion for limiting the extent of insertion of the plug into the chamber and including structure for cooperatively engaging the latch for facilitating latching the plug into the chamber when the plug is inserted sufficiently far into the chamber and for facilitating unlatched removal of the plug from the chamber upon depression of the latch, and the housing including a protective member extending forwardly therefrom at least partially adjacent the orifice, the protective member extending forwardly beyond the projecting portion.

DETAILED DESCRIPTION OF PREFERRED EMBODIMENTS

Figures 1, 2:
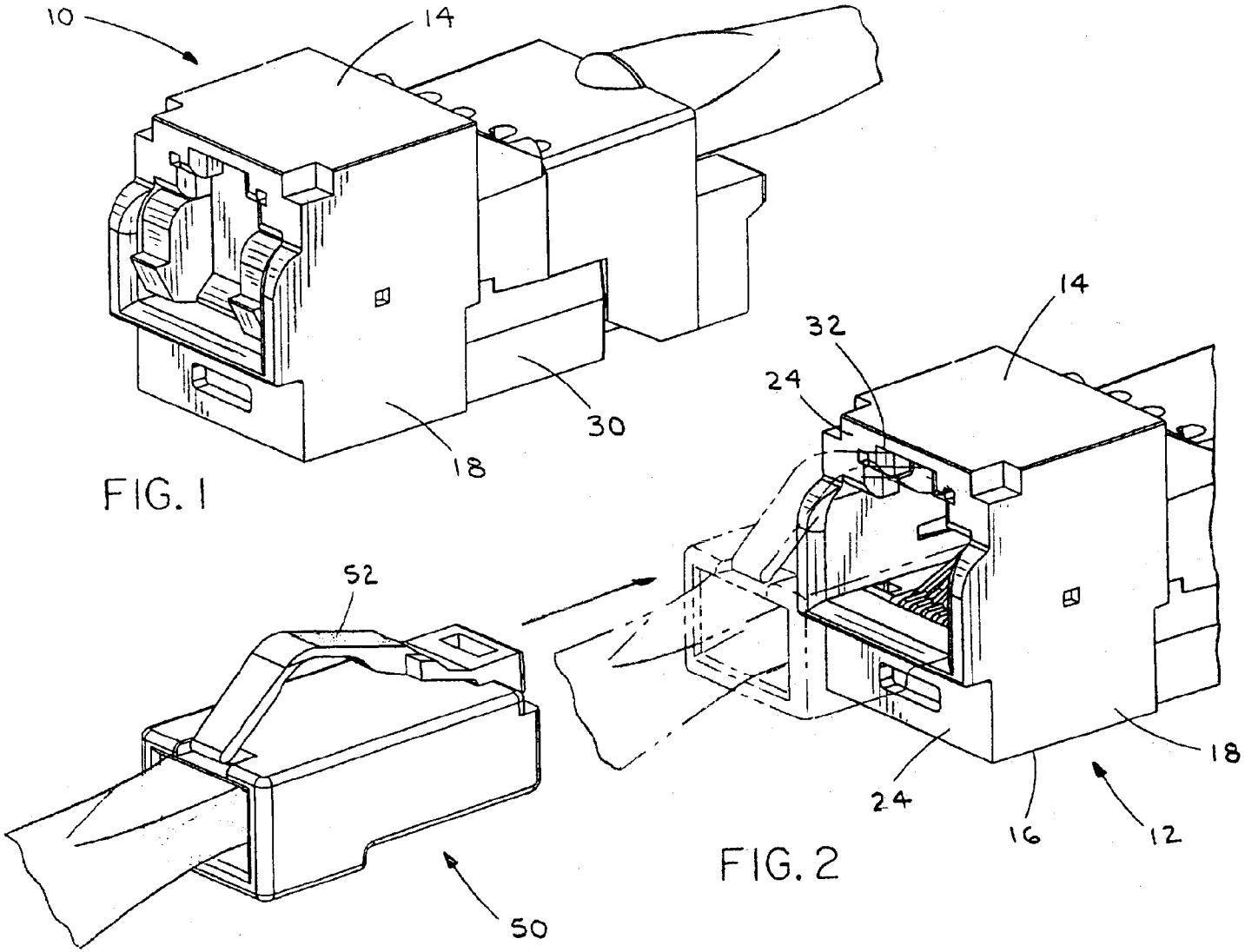
FIG. 1 is a front, upper, right side perspective view of a jack in accordance with an embodiment of the invention.
FIG. 2 is a perspective view of the intermatability and alignment between the jack of FIG. 1 and a plug matable with the jack.

A preferred embodiment and an alternate preferred embodiment of the inventive connector are shown in the figures and described herein below. In the preferred embodiment, the connector takes the form of a TX-style jack 10 that includes a housing 12 having a plug-receiving chamber therein for receiving a cooperatively engageable TX-style plug 50 and thereby connecting with the plug, as seen in FIGS. 1 and 2. The inventive connector could alternatively take the form of a different type of electrical connector, or even a fiber optic connector.

In a preferred embodiment, the housing 12 includes a top wall 14, a bottom wall 16, and a pair of side walls 18 that cooperatively define a plug-receiving chamber 20 therebetween. Though the front of the housing 12 includes an orifice 22 for receiving the appropriately configured plug 50 therethrough, the front may also preferably include a partial front wall 24 that extends inwardly from one or more of the top, bottom and side walls. The rear of the housing 12 also has an opening 26, as easily seen in FIGS. 3 and 4, so that a door 28 and sled 30 may be inserted therethrough and into the plug-receiving chamber 20. FIG. 2 shows the intermatability and alignment between the plug and jack. The plug 50 is a standard TX plug having a latch 52 thereon for releasably securing the plug within the jack when inserted therein. The latch 52 depressibly fits through a notch 32 coming off the orifice 22 in the partial front wall 24.

Figure 3:
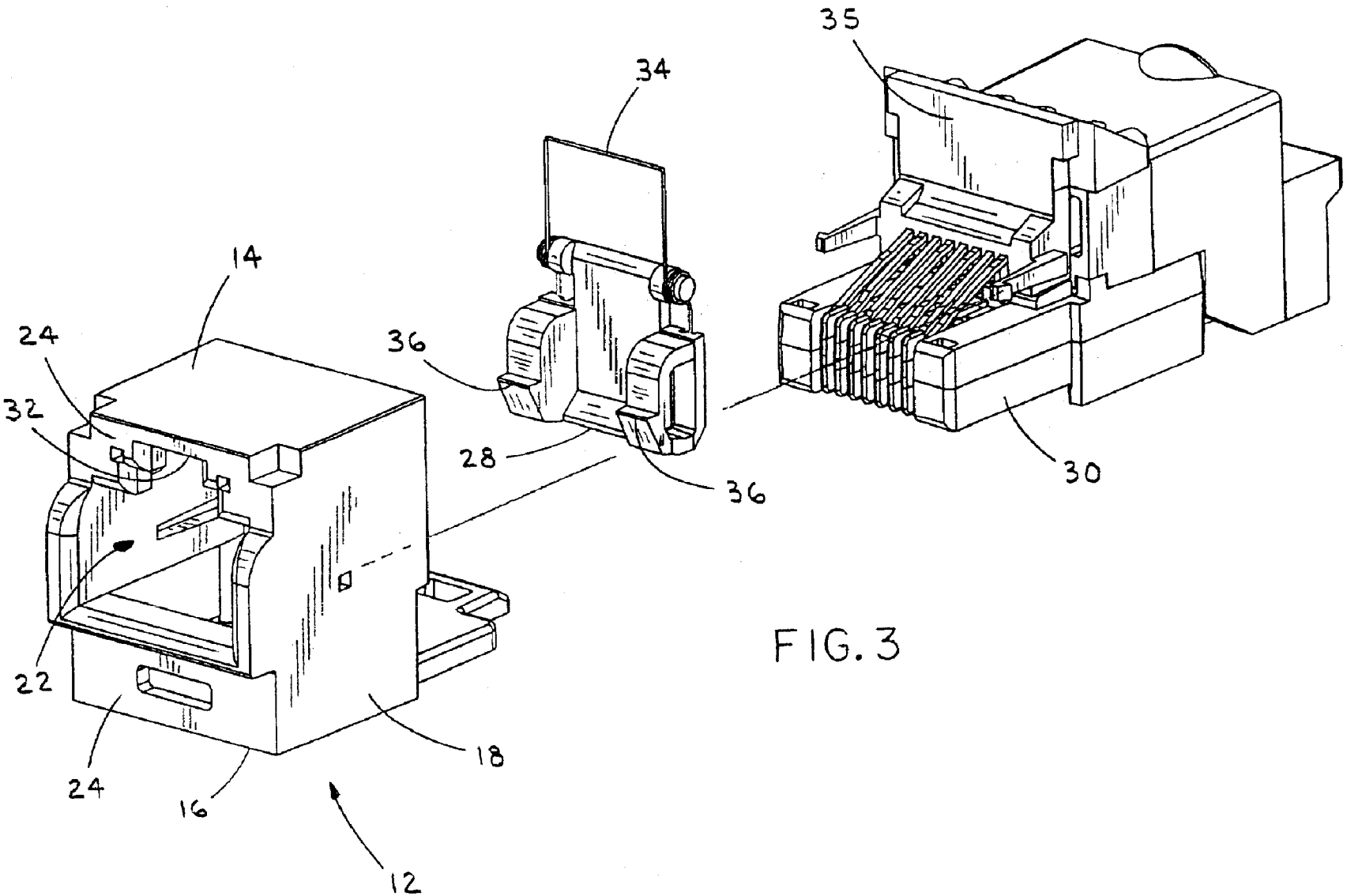
FIG. 3 is an exploded front, upper, right side perspective view of the jack of FIG. 1.
Figure 4:
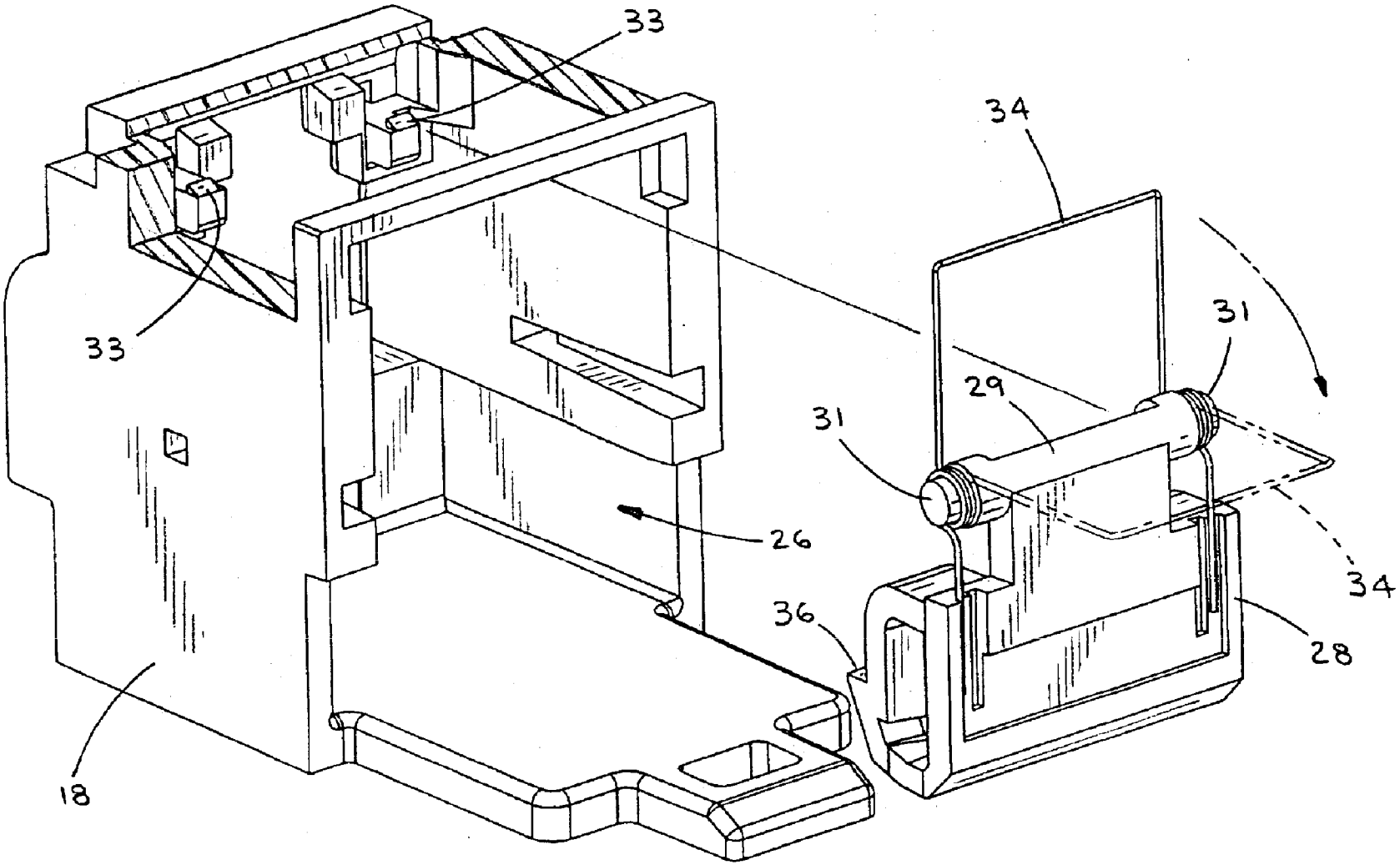
FIG. 4 is a rear, upper, right side perspective view of a front portion of the jack of FIG. 1 wherein the door and biasing mechanism are exploded therefrom for better viewing.
Figure 5:
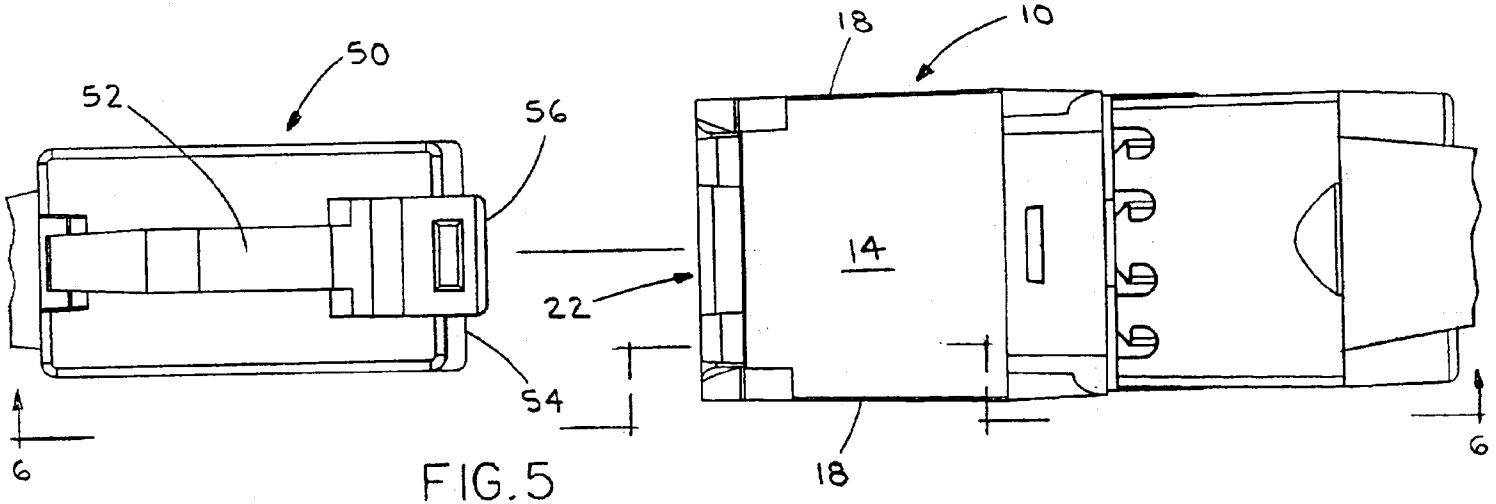
FIG. 5 is a top plan view of the jack and plug of FIG. 2.
Figure 6:
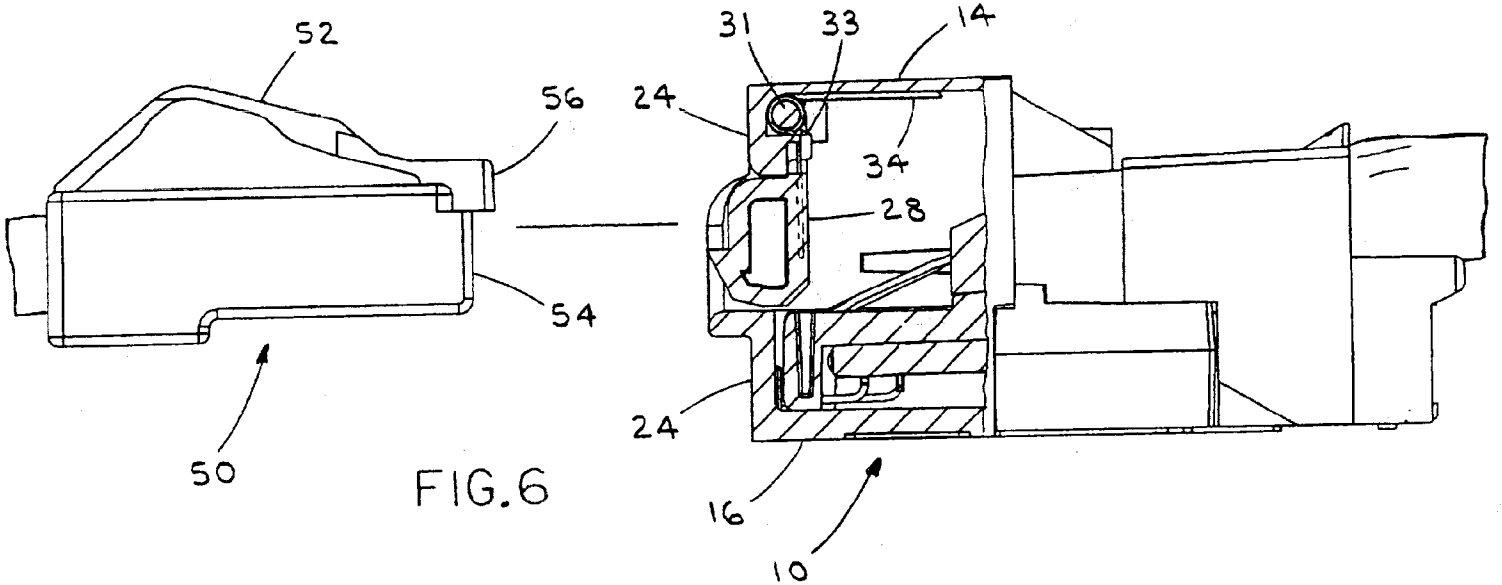
FIG. 6 is a right side elevational view of the jack and plug of FIG. 5, with a portion of the jack shown in cross-section as taken from the line 6—6 in FIG. 5, wherein the plug has not yet begun to enter the jack.

FIG. 3 explodedly shows the door 28 being disposable within the housing 12 in front of the sled 30 and bulkhead 35. In this embodiment, the door 28 includes a torsional spring 34 for supplying bias thereto. As seen in FIG. 4, when the torsion spring is rotated around the shaft 29 of the door 28 in the direction of the arrow shown (clockwise when viewed from the right side of the jack) so that the door may be inserted into the rear opening 26 of the housing 12, this applies pre-bias to the door 28 such that the door would be urged in a similar direction around the door shaft 29. As seen in FIG. 6, the door is installed into the housing by pushing opposite ends 31 of the shaft 29 past the ramped shaft stops 33. When the sled 30 is fully inserted, the sled preferably rests entirely below the door 28, and the contacts on the sled preferably do not impede the ability of the door to rotate about its shaft 29 to abut, or nearly abut, the underside of the top wall 14 of the housing 12.

Figure 7:
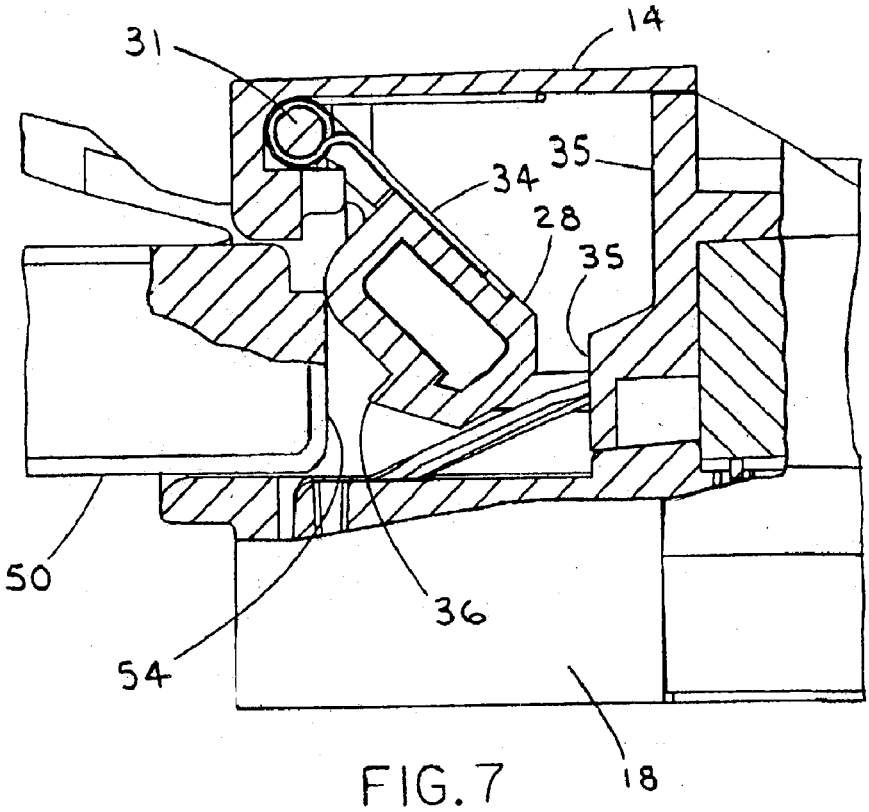
FIG. 7 is a right side elevational partially sectioned view of the jack of FIG. 6, taken along the line 7—7 in FIG. 6, wherein the plug has begun to enter the jack.
Figure 8:
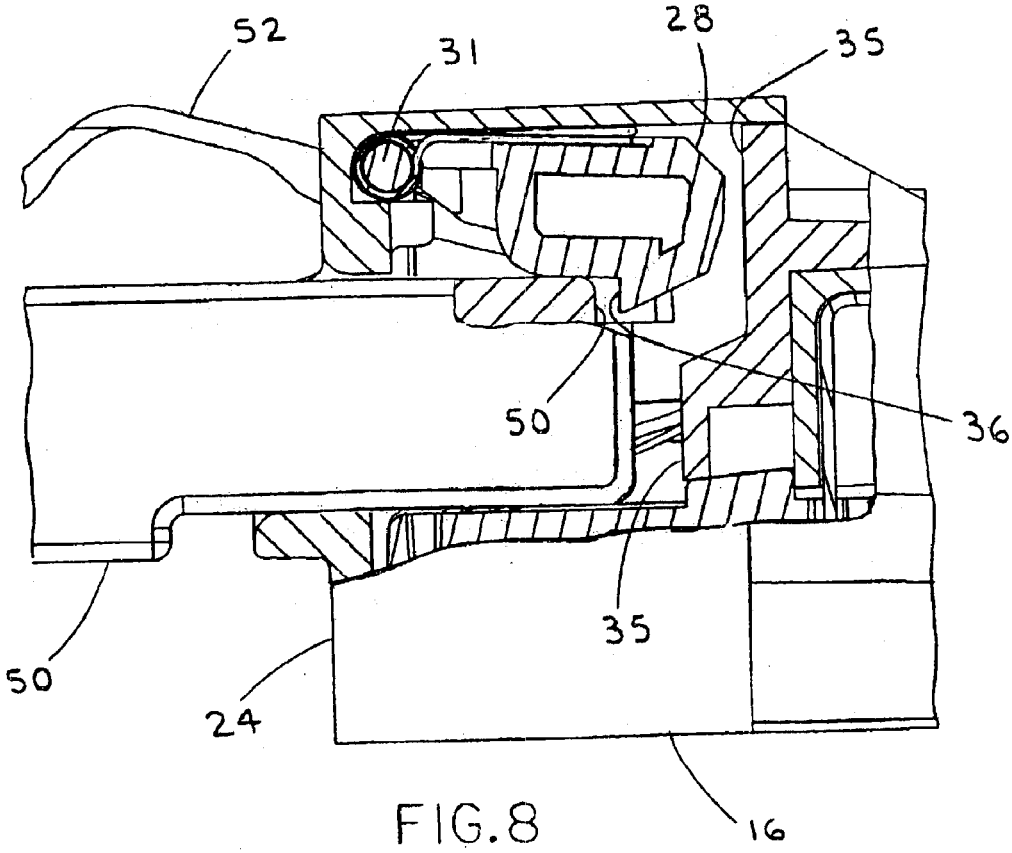
FIG. 8 is a right side elevational partially sectioned view of the jack of FIG. 6, taken along the line 7—7 in FIG. 6, wherein the plug is almost fully inserted into the jack.
Figure 9:
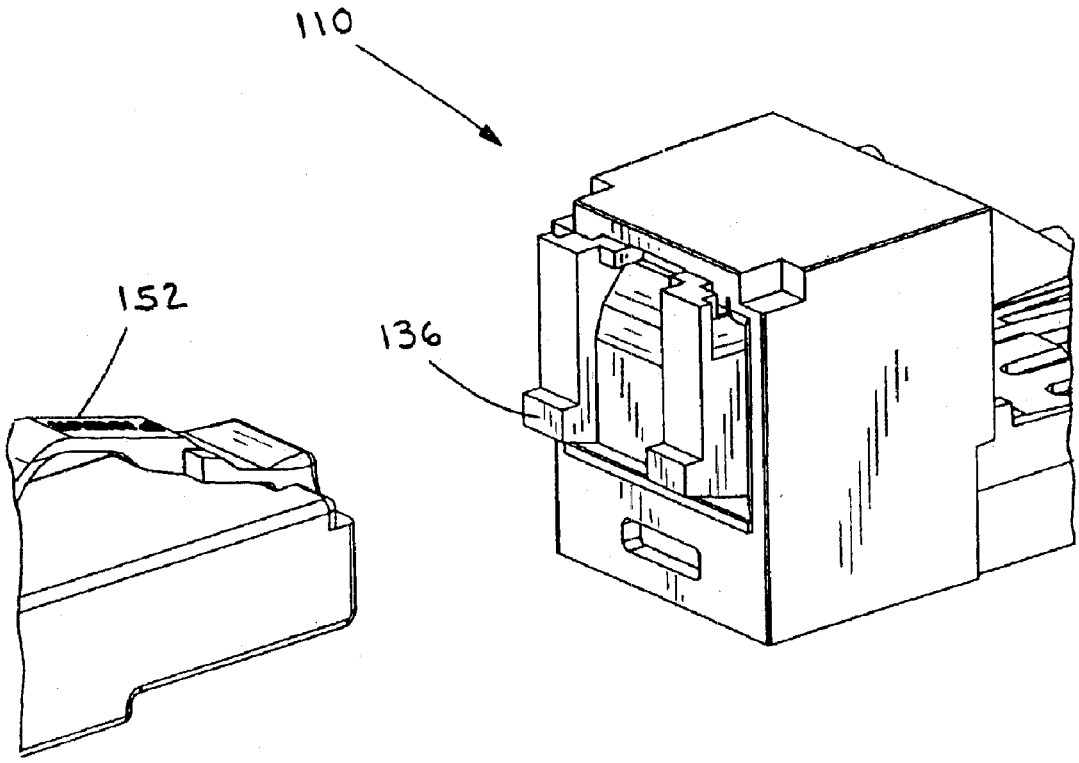
FIG. 9 is a front, upper, right side perspective view of an alternative embodiment of a jack in accordance with the invention, a portion of an uninserted compatible plug also being shown.
Figure 10:
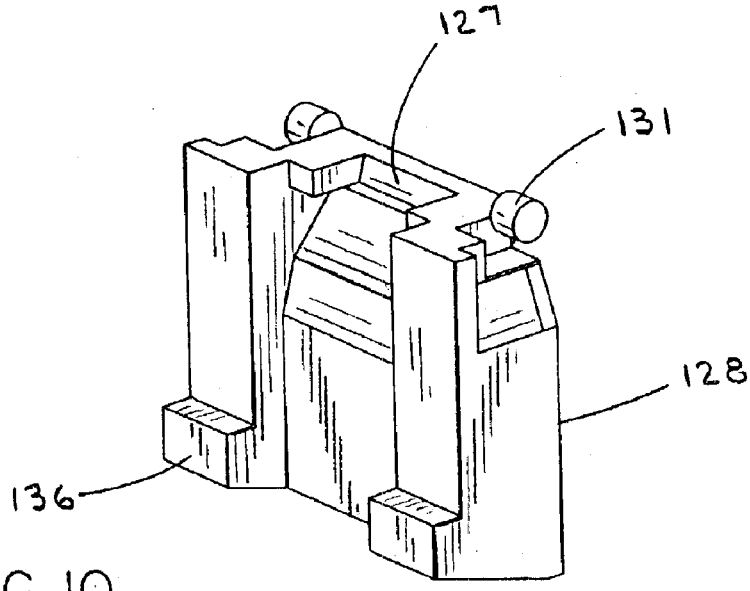
FIG. 10 is a perspective view of the door of the jack of FIG. 9 wherein the door has been removed from the plug so that it may be more easily viewed.
Figure 11:
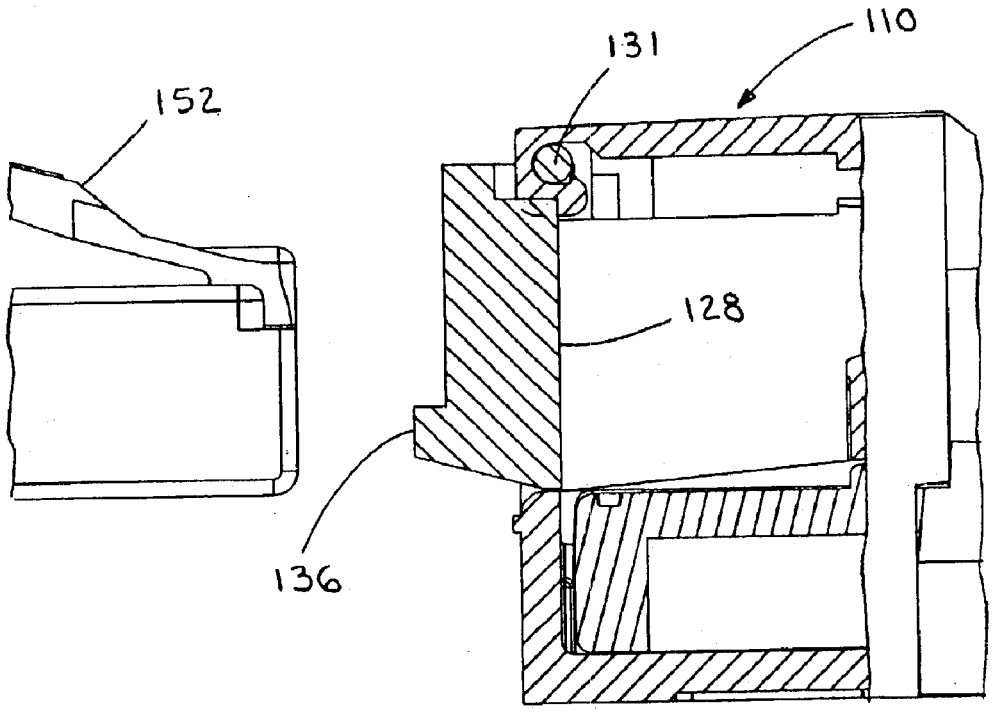
FIG. 11 is a cross-sectional view of the jack and plug of FIG. 9 taken through an extending portion of the door.
Figure 12:
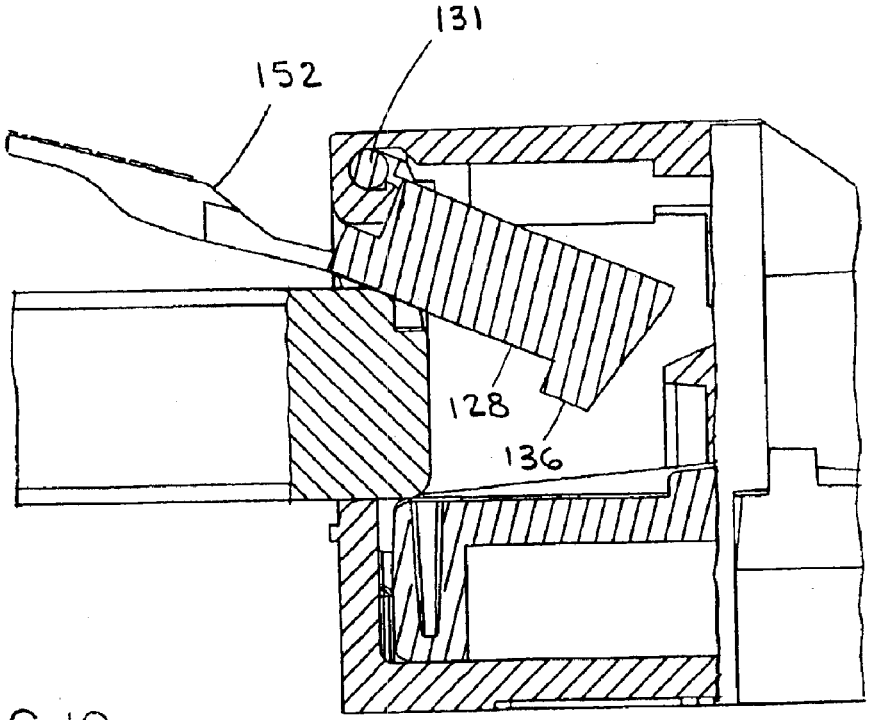
FIG. 12 is a cross-sectional view akin to that of FIG. 11 wherein the plug is partially inserted within the connector.
Figure 13:
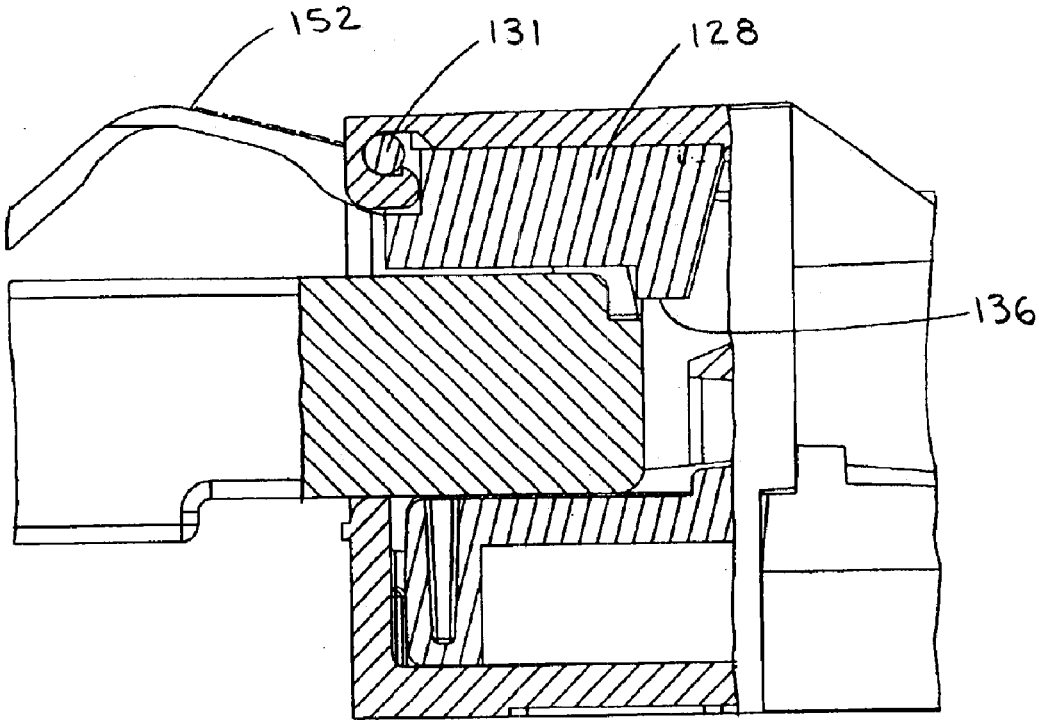
FIG. 13 is a cross-sectional view akin to that of FIG. 12 wherein the plug is fully inserted within the connector.
Figure 14:
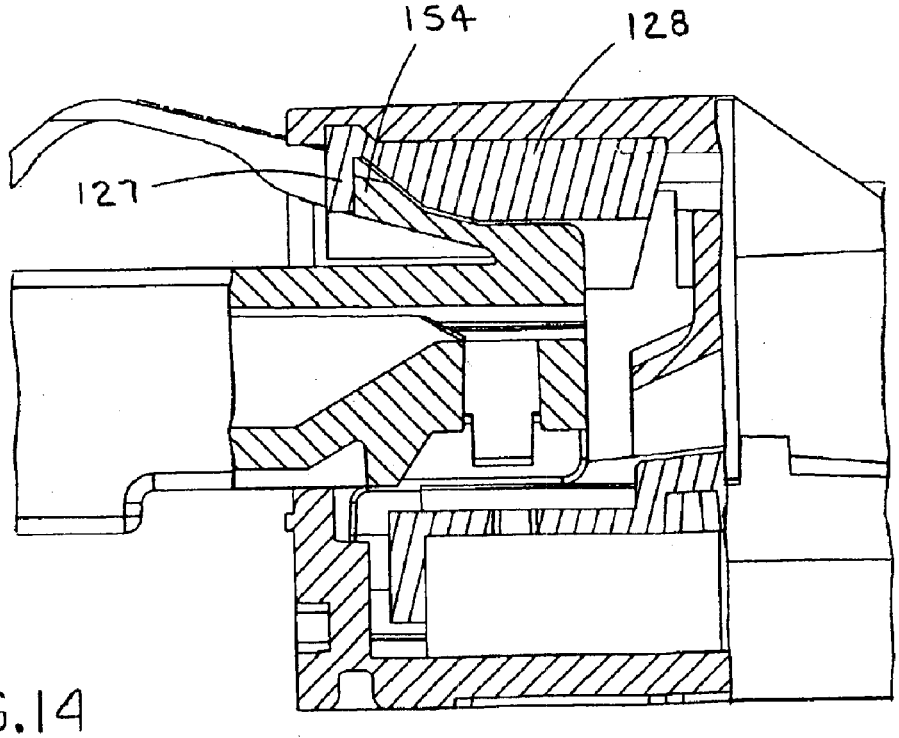
FIG. 14 is a cross-sectional view of the jack and fully inserted plug of FIG. 13 wherein the section is taken through the latching mechanism.

As seen in the sequence of FIGS. 6–8, that collectively depict the insertion of the plug into the jack, the front face 54 of the plug 50 or the front portion 56 of the latch 52 first contacts the door 28 that is pre-biased forwardly to substantially close the front orifice 22 of the housing 12. The contact force rotates the door 28 (counterclockwise when seen from right side view of the figures) against the bias of the torsion spring 34 that is wrapped around the shaft 29 and flush, or nearly flush, against the underside of the top wall 14 of the housing 12. Preferably, the plug and door are configured, depending upon whether and what type of electrical contacts, or even fiber optic fibers, are present, such that the electrical contacts (or fibers) are spared any of the contact force between the plug and door when the plug is being inserted. In the embodiment of FIGS. 1–8, for example, the electrical contacts of the plug would be near the bottom of the plug, while the contact with the door of the jack would occur in the upper portion of the front face 54 of the plug, or possibly on the front portion 56 of the latch. In this way, the signal transmission medium, i.e., the set of contacts, is spared contact forces that may deleteriously affect the quality of transmissions therethrough. Importantly, the door 28 includes forwardly extending projections 36. In at least one embodiment considered to be within the scope of the invention, one or more of the projections 36 is/are the first portion(s) of the door contacted by the plug 50. This is one means by which contact forces being applied to the transmission medium during plug insertion may be averted.

As seen in FIG. 8 particularly, where the plug 50 is almost fully inserted into the jack 10, the extent of insertion is limited by at least one of the projections 36 on the door, with the projections contacting the plug in a manner so as to apply no contact forces to the signal transmission medium, i.e., the electrical contacts. In this manner, the transmission medium is protected both upon the plug initially engaging the door as it is first entering the jack (due to the recessed portion of the door) and upon full insertion into the jack. This protection at full insertion prevents the bulkhead 35 or other structure within the jack from applying contact forces to the signal transmission medium as the maximum extent of plug insertion is reached. Protection throughout the insertion process can be critical to the performance of the transmission medium. Overtravel stops extending forwardly from the front of the door are provided to achieve such protection. Additionally, the door itself inhibits the entry of foreign debris into the connector, so the door having overtravel stops prevents the connector from failing to achieve high performance in two ways.

As shown in FIGS. 9–14, another preferred embodiment of the invention includes latch receiving structure on the door, rather than in the front upper portion of the housing. As seen in these figures, jack 110 includes a similarly biasable door 128 that also includes forwardly directed projections 136 on the front thereof. The projections function similarly to those of the previously described embodiment(s). As seen from these figures, the plug latch 152 includes a truncated portion 154 that latches into the latch-receiving portion 127 of the door 128 to releasably retain the plug within the jack 110. Such an arrangement may provide space savings within the connector.

It is easily observed that the invention described herein is not limited to the particular embodiment(s) described above and/or shown in the accompanying figures. Rather, it is anticipated that the inventive connector door having overtravel stops is applicable to many other connector designs. By way of examples, and not to be construed as limiting in any way, alternative embodiments might include connectors other than a TX jack, such as a mini-jack style electrical connector, or a fiber optic connector, connectors having any shape, connectors that are test jacks wherein the anticipated use is for testing the insertable plug/fiber rather than providing long-term connection, connectors having overtravel stops disposed in other places on the door wherein they are still cooperative with the structure of the plug to function as overtravel stops, connectors configured for receiving unlatched plugs instead of, or in addition to, latched plugs, and connectors wherein the door is biased by means other than a torsion spring. The scope of the invention is defined by the following claims.

I claim:

1. A jack for receiving and connecting with a compatible plug, said plug including a depressible latch, said jack comprising:

a housing including a pair of opposed top and bottom walls, a pair of opposed side walls extending between said top and bottom walls, and a rear bulkhead, said top, bottom, side walls and said rear bulkhead substantially defining a chamber having a forwardly facing orifice through which said plug is insertable into and removable from said chamber, said rear bulkhead not being integrally formed with any of said top, bottom, and side walls; and a pivotable prebiased door having a torsional spring mounted thereto and having a closed position generally disposed over and flush with said orifice when said plug is not disposed within said chamber to substantially prevent foreign matter from entering said chamber and an open position not generally disposed over said orifice when said plug is disposed within said chamber;

said door including a projecting portion for limiting the extent of insertion of said plug into said chamber and including structure for cooperatively engaging said latch for facilitating latching said plug into said chamber when said plug is inserted sufficiently far into said chamber and for facilitating unlatched removal of said plug from said chamber upon depression of said latch; and said housing including a protective member extending forwardly therefrom at least partially adjacent said orifice, said protective member extending forwardly beyond said projecting portion.

2. A jack in accordance with claim 1 wherein said protective member includes a guide-in portion for facilitating insertion of said plug through said orifice.

3. A jack in accordance with claim 2 wherein said prebiased door is biased against said plug when said plug is disposed within said chamber to facilitate electrical connection between said plug and said jack.

* * * * *